US005863236A

United States Patent [19]

Johnson

[11] Patent Number: 5,863,236

[45] Date of Patent: Jan. 26, 1999

[54] SIZE ADJUSTABLE BRA STRUCTURE

[76] Inventor: Christina Erteszek Johnson, 21914 Goldstone Rd., Topanga, Calif. 90290

[21] Appl. No.: 967,642

[22] Filed: Nov. 10, 1997

[51] Int. Cl.[6] ..... A41C 3/00; A41C 3/12

[52] U.S. Cl. ..... 450/62; 450/60; 450/63; 450/64; 450/79; 450/84

[58] Field of Search ..... 2/76, 67, 69, 105, 2/106, 113, 114, 115, 109, 110; 450/4, 5, 6, 8, 10, 19, 20, 21, 23, 25, 28, 26, 58, 59, 60, 61, 62, 63, 64, 65, 66, 67, 68, 70, 74, 75, 76, 77, 79, 80, 85, 82, 83, 84, 92, 93

[56] References Cited

U.S. PATENT DOCUMENTS

| | | | |
|---|---|---|---|
| 1,306,595 | 6/1919 | Jerome | 2/110 |
| 1,352,974 | 9/1920 | Kops | 450/85 |
| 1,494,119 | 5/1924 | Kops | 450/77 X |
| 2,100,890 | 11/1937 | Witkower | 450/63 X |
| 2,378,908 | 6/1945 | Blum . | |
| 2,650,363 | 9/1953 | Lo Cascio | 450/63 |
| 3,131,696 | 5/1964 | Krakower | 450/70 X |
| 4,781,651 | 11/1988 | Ekins | 450/25 X |
| 5,221,227 | 6/1993 | Michels | 450/8 X |

FOREIGN PATENT DOCUMENTS

| | | | |
|---|---|---|---|
| 857747 | 1/1961 | United Kingdom | 450/77 |

OTHER PUBLICATIONS

Gershman, Maurice, "Self Adhering Nylon Tapes," The J.A.M.A., vol. 168, No. 7, p. 930, 1958.

*Primary Examiner*—Jeanette Chapman
*Attorney, Agent, or Firm*—William W. Haefliger

[57] ABSTRACT

A fit adjustable brassiere comprising front structure including two transversely spaced local bust-support panels, and a flexible, frontal, fabric panel between and interconnecting said bust-support panels at the front side of the brassiere, a halter, including two transversely spaced support bands having lower frontal extents associated with said front structure and extending upwardly relative to said two bust-support panels, respectively, and then downwardly at the rear side of the brassiere to define lower rearward extents; and rear structure associated with and extending below said band lower rearward extents; there being at least one wing carried by one of said front and rear structures, and configured to freely extend from said one structure toward said other structures at one side of the brassiere, and to adjustably attach to the surface of said other structure to adjust the fit of the brassiere to the wearer.

12 Claims, 5 Drawing Sheets

FIG. 5.
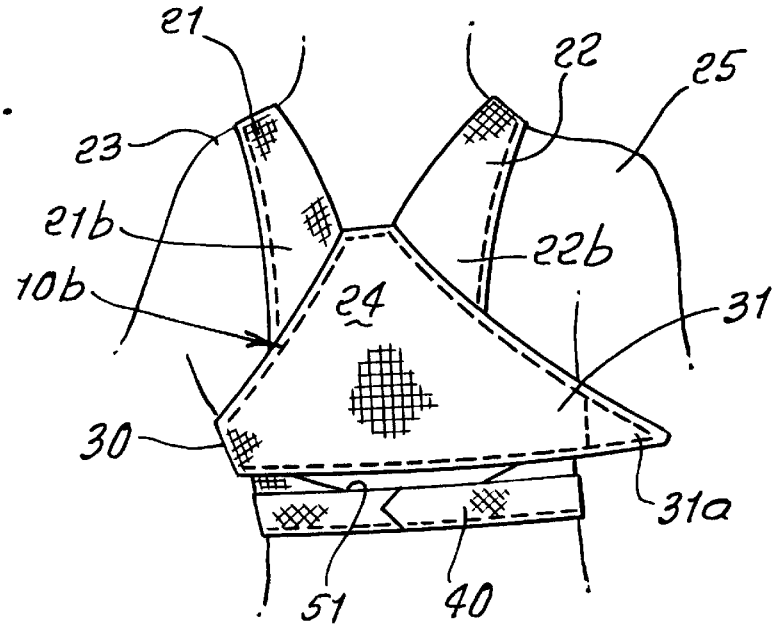
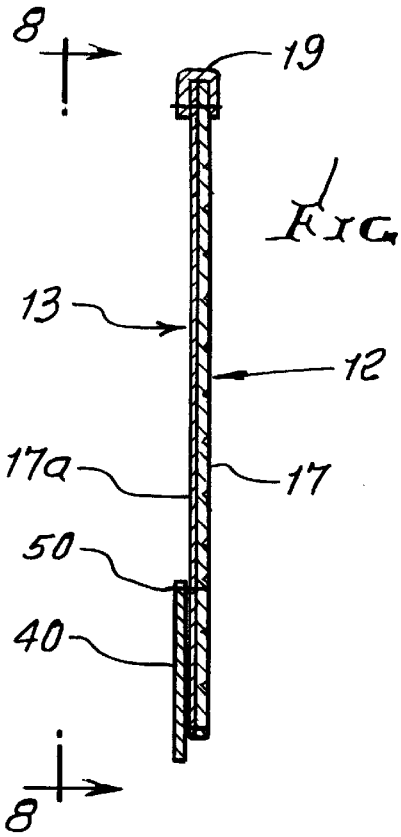
FIG. 7.
FIG. 8.
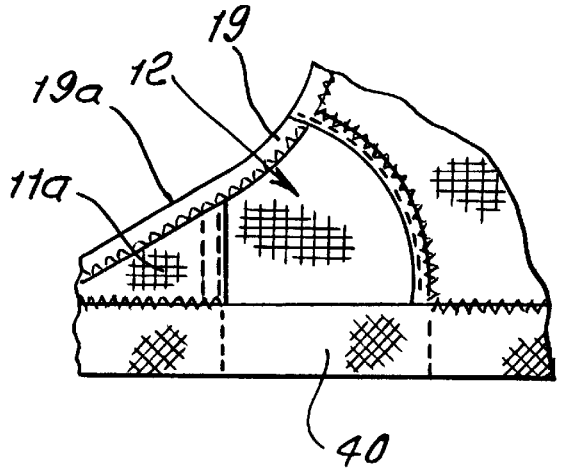

SIZE ADJUSTABLE BRA STRUCTURE

BACKGROUND OF THE INVENTION

This invention relates generally to brassieres, and more particularly to an improved brassiere providing very comfortable and readily adjustable fit to the wearer's torso.

There is continual need for brassieres that provide enhanced comfort and readily adjustable fit. Traditional bras provide bust control via shoulder strap adjustment. This often causes discomfort in the neck and back areas. There is also need for improved active wear brassieres, as for example are worn during active exercise, and which provide constant comfort and support, and which enable readily adjustable fit. For example, a brassiere should be capable of ready, partial loosening, as after active, vigorous exercise, and still provide needed support for comfort. There is additional need for a bra that controls the bust cup capacity and the sides of the busts, together or independently of one another.

SUMMARY OF THE INVENTION

It is a major object of the invention to provide an improved wrap support brassiere meeting the above needs. Basically, the improved brassiere is wrap-fit adjustable, as well as size adjustable, and comprising, in combination:

a) front structure including two transversely spaced local bust-support panels, and a flexible, frontal, fabric panel between and interconnecting the bust-support panels at the front side of the brassiere, b) a halter, including two transversely spaced support bands having lower frontal extents associated with the front structure and extending upwardly relative to the two bust-support panels, respectively, and then downwardly at the rear side of the brassiere to define lower rearward extents, c) and rear structure associated with and extending below the band lower rearward extents, d) there being at least one wing carried by one of the front and rear structures, and configured to freely extend from the one structure toward the other structure at one side of the brassiere, and to adjustably attach to the surface of the other structure to adjust the fit of the brassiere to the wearer.

It is another object to provide the one wing to have adjustable position attachment to the surface of one of the local bust-support panels. As will appear, one local bust-support panel may include fabric defining its surface, which is quilted for stabilizing the attachment. Such attachment may advantageously include hook and pile elements respectively on the fabric surface and on one wing.

Another object of the invention includes provision of elasticized means associated with the front and rear structures for firmly holding lower extent of the brassiere to the torso of the wearer. Such elasticized means may include a band having operative connection to lower extents of the two local bust-support panels.

A further object includes provision of a second wing configured to adjustably interconnect the front and rear structures, and at the other side of the brassiere. That second wing may typically extend from said one structure toward the other of said structures at the opposite side of the brassiere, and to adjustably attach to the surface of the other structure to adjust the fit of the brassiere to the wearer.

As will appear, the construction may be such that:

i) one wing has adjustable position attachment to the surface of one of the local bust-support panels, and ii) second wing has adjustable position attachment to the surface of the other of the local bust-support panels.

Yet another object concerns orientation of the two wings, such that one wing is at the left side of the brassiere and oriented to direct loading toward a halter band at the upper right side of the brassiere, and the other wing is at the right side of the brassiere, and oriented to direct loading toward a halter band at the upper left side of the brassiere.

Additionally, one or more of flexible, frontal and flexible rear panels of the brassiere, as well as the halter bands, may consist of a soft, two-way stretchable knit fabric, the wing or wings associated with the rear panel, for maximum comfort.

These and other objects and advantages of the invention, as well as the details of an illustrative embodiment, will be more fully understood from the following specification and drawings, in which:

DRAWING DESCRIPTION

FIG. 5 is a view like FIG. 2 but showing the other adjustable wing detached from the right front side of the brassiere;

FIG. 7 is an enlarged section taken on lines 7—7 of FIG. 6; and

FIG. 8 is a fragmentary view taken on lines 8—8 of FIG. 7;

DETAILED DESCRIPTION

Figure 9:
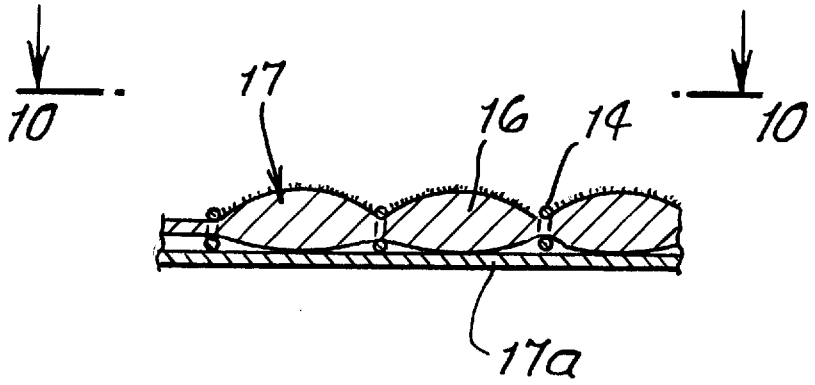
FIG. 9 is a section showing quilted appearance.
Figure 10:
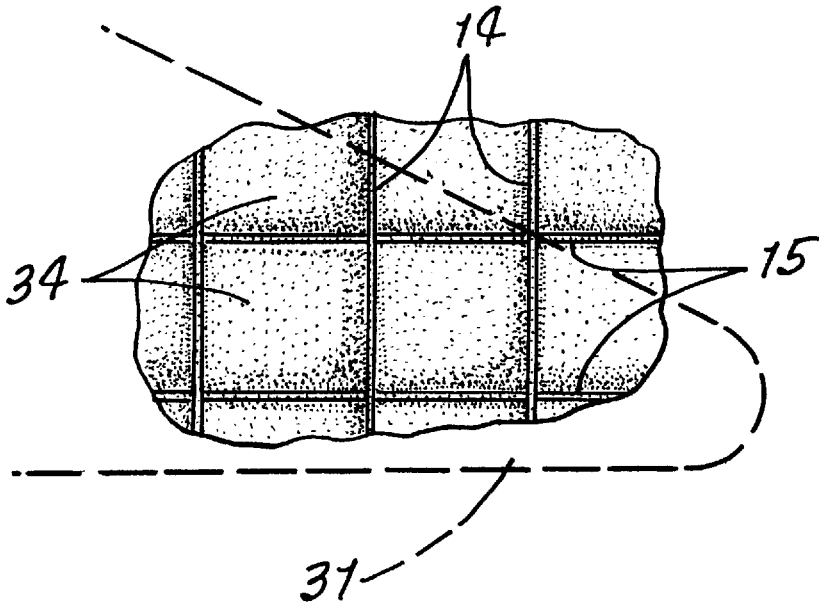
FIG. 10 is a plan view on lines 10—10 of FIG. 9.

In the drawings, the brassiere 10 comprises front structure 10*a* that includes transversely spaced, local, left and right bust-support panels 11 and 12, and a flexible, frontal panel 13 between and interconnecting panels 11 and 12 at the brassiere front. Structure 13 consists of comfortable, two-way, stretchable knit fabric, such as cotton; and panels 11 and 12 typically consist of layered, heavier fabric structure, which may be reinforced by spaced parallel stitches 14, and spaced parallel stitches 15 extending cross-wise of stitches 14. See FIGS. 9 and 10 showing the resultant "quilted" appearance, with outstanding four-sided lands 16. Each panel includes an outer, relatively thicker layer 17 that is cross stitched, and an inner, thin, cotton layer 17*a* extending adjacent the underside of the layer 16. Layer 16 may consist of plush cotton batting. Such cross-stitching causes the layer 16 to be much less flexible than relatively thinner front fabric panel 13. A stiffened, hemmed zone borders each panel 11 and 12, as at locations 18, 19, and 20. Zones 18 and 19 taper upwardly to a peak zone 18*a*.

The brassiere also includes two transversely spaced support bands 21 and 22, which may advantageously be between ¾ and 1½ inches in width. These bands have lower frontal extents at 21*a* and 22*a* that are associated with the front structure 10*a*. For example, the bands may be connected to the upper extents 13*a* and 13*b* of front panel 13, overlying peak zones 18*a,* as shown. The two bands extend upwardly relative to the two less flexible local support panels 11 and 12, and cross rearwardly over the wearer's shoulders 23 and 25, and then downwardly at the rear side of the brassiere to define band lower rearward extents 21*b* and 22*b,* which are widened. See FIG. 5.

The brassiere 10 also includes rear structure 10*b* associated with and extending below band lower extents 21*b* and 22*b;* and in the example shown, the rear structure includes an upwardly tapering rear panel 24 connected by stitching to the bands. The bands 21 and 22, and rear panel 24, may also consist of comfortable, two-way stretchable fabric, such as a thin layer of cotton knit material.

In accordance with an important aspect of the invention, at least one wing is carried by one of the front and rear structures 10*a* and 10*b,* and configured to extend from that one structure toward the other structure, and at one side of the brassiere. See for example wing 30 or wing 31, two or both such wings preferably being used, and extending forwardly, as seen in FIG. 1, to enable the wearer to easily adjust their attachment to surfaces of the panels 11 and 12, at the front structure 10*a.* The wings are press-on attachable to the outer or inner sides of the bust support panels.

Figure 1:
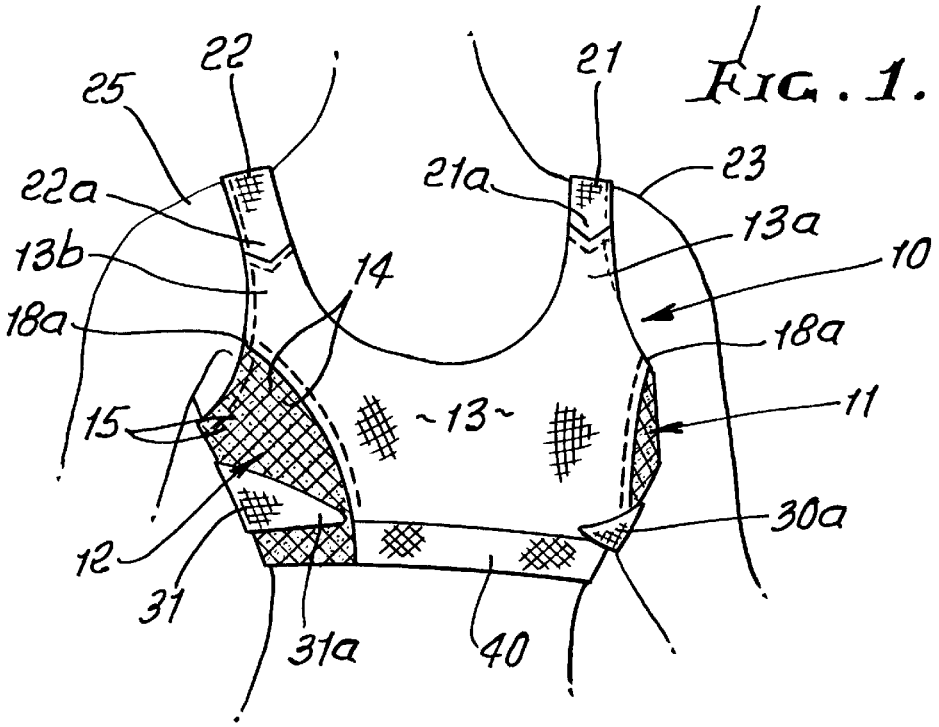
FIG. 1 is a frontal view showing an adjustable brassiere incorporating the invention.
Figure 2:
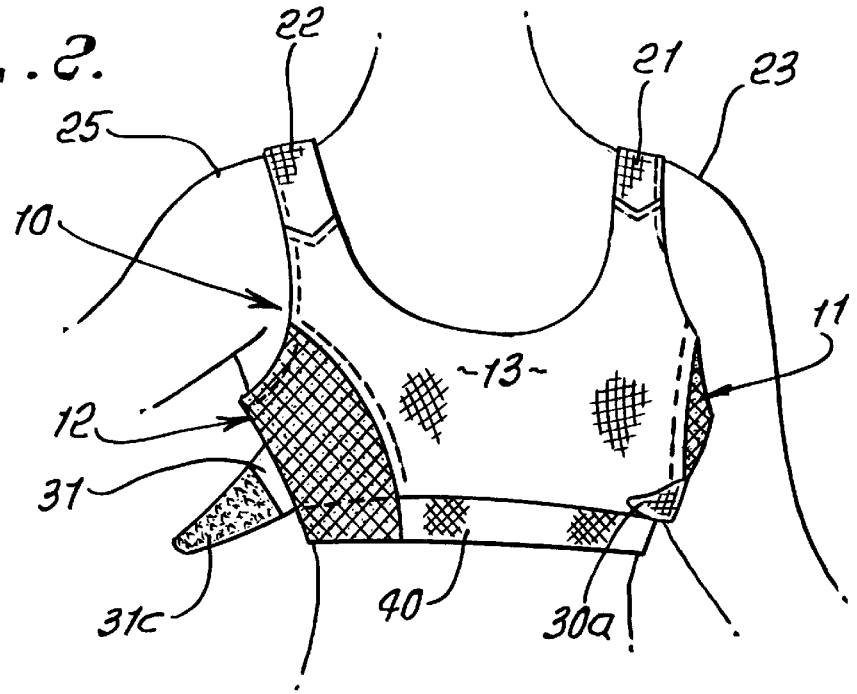
FIG. 2 is a rear view of the brassiere seen in FIG. 1 but showing one adjustable wing detached from the left front side of the brassiere.
Figure 3:
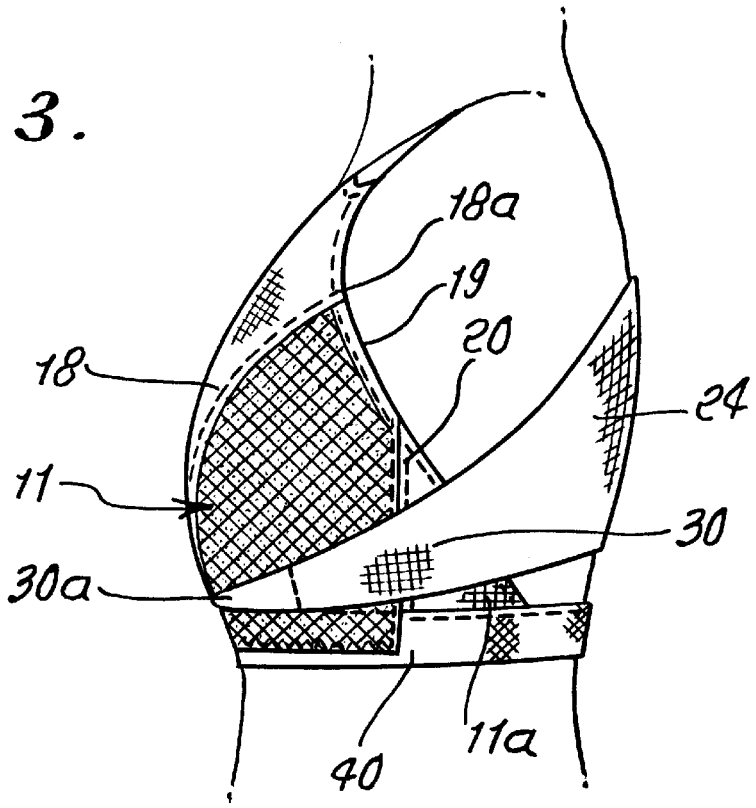
FIG. 3 is a left side view of the brassiere seen in FIG. 1.
Figure 4:
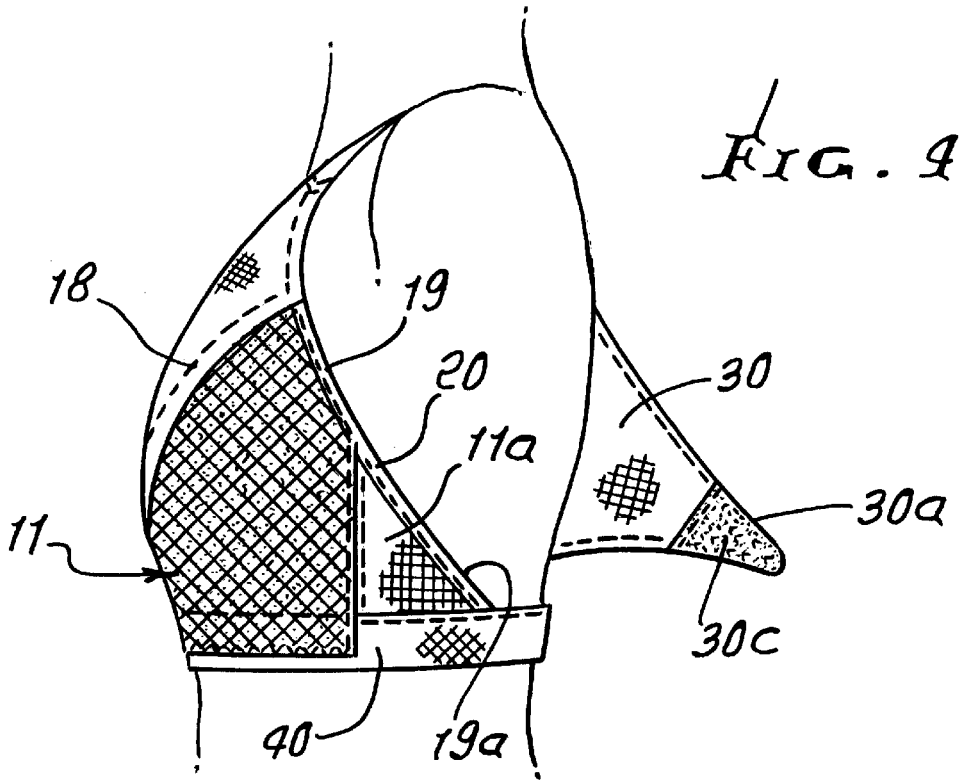
FIG. 4 is a view like FIG. 3 showing an adjustable wing of the brassiere detached from the front side of the brassiere.
Figure 6:
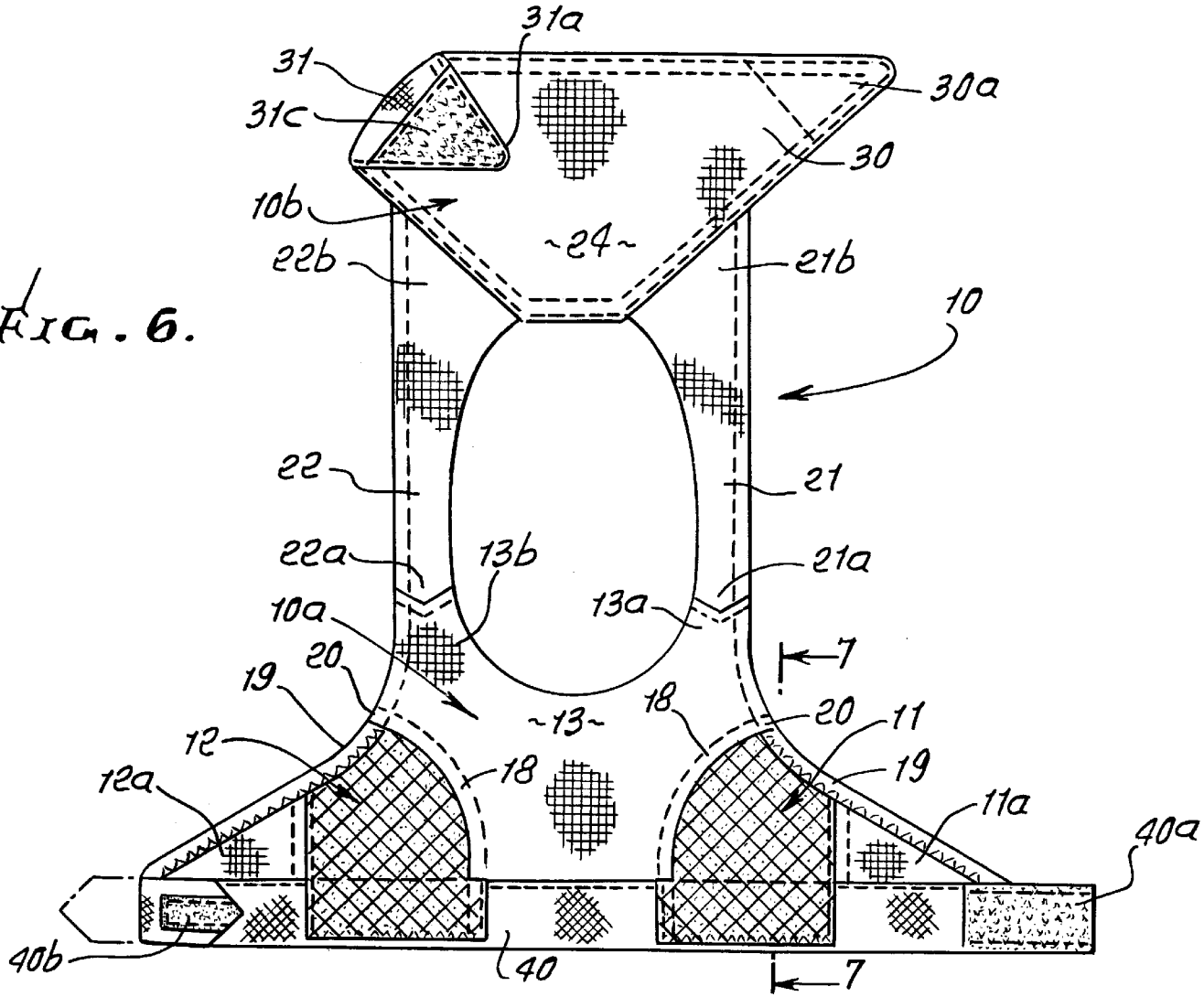
FIG. 6 is a plan view of the FIG. 1 brassiere, shown as supported on a flat surface.

The wings shown as carried by or associated with rear structure 10*b,* and taper forwardly, as seen in FIGS. 1 and 6, so as to provide narrowed tip portions 30*a* and 31*a* easily manually adjustable for surface attachment to panels 11 and 12. The wings may also consist of two-way stretchable fabric, such as thin cotton knit fabric material.

Wings 30 and 31 have independently adjustable position attachment to the outer surfaces of the respective panels 11 and 12. Such attachment is to the surfaces 34 of the quilted fabric bands, enabling ease of press-on attachment, and removable for adjustment purposes, as facilitated by their forward narrowing or taper. Such adjustment in any direction parallel to the panel surface (i.e., up, down, or sidewise) enables ease of adjustment fitting of the brassiere to the wearer's upper torso, each time the brassiere is worn; and allows for rapid adjustable loosening of either or both sides of the brassiere, for example after vigorous exercise, for comfort purposes.

Figure control is also enabled, since wing narrowed tip portions 30*a* and 31*a* may be press-attached to lower portions of the panels 11 and 12 to exert inwardly directed and localized pressure under the bust side areas, the panels 11 and 12 acting to spread or distribute such pressure for comfort.

Surface-to-surface attachment of the wings to the panels may be provided, as by VELCRO attachment, indicated by hook zones 30*c* and 31*c* on the wings, and pile zones provided by the different areas of the panel fabric.

The brassiere also preferably includes elasticized means associated with the front and rear structures 10*a* and 10*b* for firmly holding or retaining lower extents of the brassiere to the torso of the wearer, under the bust level. As shown, such elasticized means includes a lengthwise yieldably resiliently stretchable band or bands 40 having operative connection to lower extents of the panels 11 and 12, and encircling the torso. End extents 40*a* and 40*b* of the band or bands may adjustably interconnect, as by VELCRO attachment. The band or bands may also be stitch connected to lower edge portions of the front and rear panels 13 and 24, as at 50 and 51.

Finally, triangular side panels 11*a* and 12*a* connect stiffened zones 20 with band 40, beneath lower continuation 19*a* of the stiffened zones 19.

From the above, it will appear that the invention provides the following advantages:

a) the bra controls bust cup capacity, and the sides of the busts, together or independently of one another;

b) front and back compression, achieved by the adjustable wrapping feature, and by the full back yoke design, lessens pressure on the neck and shoulders, and improves posture, c) the improved bra design is of particular advantage to large-busted women because control and support are achieved by the back-to-front adjustable wrap construction.

I claim:

1. In a fit adjustable brassiere, the combination comprising;

a) front structure including two transversely spaced local bust-support panels, and a flexible, frontal, fabric panel between and interconnecting said bust-support panels at the front side of the brassiere, b) a halter, including two transversely spaced support bands having lower frontal extents associated with said front structure and extending upwardly relative to said two bust-support panels, respectively, and then downwardly at the rear side of the brassiere to define lower rearward extents, c) and rear structure associated with and extending below said band lower rearward extents, d) there being a first wing carried by the rear structure and configured to freely extend from said rear structure toward said front structure at one side of the brassiere, and there being a second wing carried by said rear structure and configured to freely extend from said rear structure toward said front structure at the other side of said brassiere.

e) said wings being free of any straps connected thereto, f) and wherein i) said first wing has adjustable position attachment to the surface of one of said local bust-support panels, and ii) said second wing has adjustable position attachment to the surface of the other of said local bust-support panels, iii) said wings tapering toward tip zones that are easily pulled free of press-on attachment to said bust-support panels, iv) said wings having panel configuration and bi-directional adjustable attachment to the local bust-support panels.

2. The combination of claim 1 wherein said one local bust-support panel includes fabric defining said surface, which is quilted for stabilizing said attachment.

3. The combination of claim 1 wherein said attachment includes hook and pile elements respectively on said one local bust-support panel and on said first wing.

4. The combination of claim 2 wherein each of said adjustable position attachments is a VELCRO attachment.

5. The combination of claim 1 wherein said brassiere includes elasticized means associated with said front and rear structures for firmly holding lower extent of the brassiere to the torso of the wearer.

6. The combination of claim 5, wherein said elasticized means includes a band having operative connection to lower extents of said two local bust-support panels.

7. The combination of claim 1 wherein said local bust-support panels include fabric defining said surfaces, which are quilted.

8. The combination of claim 1 wherein said flexible frontal panel consists of two-way stretchable knit fabric.

9. The combination of claim 8 wherein said rear structure includes a flexible rear panel that consists of two-way stretchable knit fabric, said wing associated with said rear panel.

10. The combination of claim 9 wherein said halter bands consist of two-way stretchable knit fabric.

11. The combination of claim 1 wherein said first wing is at the left side of the brassiere and oriented to direct loading toward a halter band at the upper right side of the brassiere, and said second wing is at the right side of the brassiere, and oriented to direct loading toward a halter band at the upper left side of the brassiere.

12. The combination of claim 1 wherein said wings are attachable to one of the following:

i) the outer sides of said busts-support panels ii) the inner sides of said bust-support panels.

* * * * *